United States Patent [19]

Anderson

[11] 4,180,763

[45] Dec. 25, 1979

[54] HIGH INTENSITY DISCHARGE LAMP GEOMETRIES

[75] Inventor: John M. Anderson, Scotia, N.Y.

[73] Assignee: General Electric Company, Schenectady, N.Y.

[21] Appl. No.: 872,153

[22] Filed: Jan. 25, 1978

[51] Int. Cl.[2] ..... H05B 41/16; H05B 41/24

[52] U.S. Cl. ..... 315/248; 313/17; 313/25; 315/344

[58] Field of Search ..... 315/248, 344; 313/17, 313/25, 26

[56] References Cited

U.S. PATENT DOCUMENTS

| | | | |
|---|---|---|---|
| 2,961,557 | 11/1960 | Hubert | 315/248 |
| 3,500,118 | 3/1970 | Anderson | 315/248 |
| 3,987,334 | 10/1976 | Anderson | 315/248 |

FOREIGN PATENT DOCUMENTS

| | | | |
|---|---|---|---|
| 396753 | 1/1974 | U.S.S.R. | 313/26 |
| 331746 | 4/1976 | U.S.S.R. | 315/248 |
| 1334911 | 10/1973 | United Kingdom | 315/248 |

*Primary Examiner*—Saxfield Chatmon, Jr.

*Attorney, Agent, or Firm*—Lawrence D. Cutter; Joseph T. Cohen; Marvin Snyder

[57] ABSTRACT

Novel geometries for high intensity discharge solenoidal electric field lamps are disclosed providing good coupling between the magnetic fields within the ferrite and the plasma discharge. In addition, the geometries provide for good heat sinking and cooling capabilities as well as escape of most of the generated light. In accordance with one embodiment of the present invention, a plurality of toroidal shaped ferrite cores are arranged about the high intensity discharge tube, the tube being threaded through the holes in the toroidal ferrite cores. In accordance with another embodiment of the present invention, a bundle of ferrite rods is disposed through the hole of a toroidal shaped discharge tube, the packing density of the ferrite rods in the bundle being less than one hundred percent efficient whereby channels for cooling air are formed.

39 Claims, 3 Drawing Figures

HIGH INTENSITY DISCHARGE LAMP GEOMETRIES

BACKGROUND OF THE INVENTION

This invention relates to high intensity discharge lamps wherein the discharge is driven by a solenoidal electric field. More particularly, this invention relates to novel geometric structures relating the placement of the magnetic field bearing ferrites with respect to the toroidal shaped discharge tube. The primary advantage gained by the structures provided herein is the achievement of good coupling between the magnetic field within the ferrites and the plasma discharge and also the provision for a geometry in whch there is a minimum interference with the optical output of the lamp by the ferrites and in addition there are good heat sinking and cooling capabilities. Two basic geometries are described herein.

The lamps described in the invention herein are part of the class referred to as high intensity discharge lamps (HID) lamps because in their basic operation a medium to high pressure gas is caused to emit visible wavelength radiation upon excitation which is typically caused by the passage of current through an ionizable gas such as mercury vapor. The most common class of HID lamps is that in which the discharge current is caused to flow between two electrodes.

These electroded HID lamps suffer from a number of problems. First, during the operation of the lamp, there is a great tendency for the material of the electrode to be sputtered onto the surface of the lamp, blackening it and thereby reducing the optical output. Second, one of the most common causes of failure of the electroded HID lamp is the failure of the electrode itself, due to thermal and electrical stress. The life and efficiency of such tubes are therefore limited.

However, more recently, solenoidal electric field lamps have been proposed, such as the lamp described in U.S. Pat. No. 3,500,118, issued to J. M. Anderson, the same inventor herein, said patent also being assigned to the same assignee as herein. Such lamps have an electric field which is substantially circular and closes back on itself. It is along this electric field path that the discharge takes place and since it is a closed path, there is no need for electrodes and such lamps are therefore often referred to as "electrodeless lamps".

The invention herein relates to a class of lamps referred to as "high intensity discharge lamps" as noted above. Such lamps are distinguishable from ordinary fluorescent lamps in that high intensity discharge lamps typically operate at a temperature of approximately 700° C. or more and at a vapor pressure of between approximately 200 Torr, and approximately 1 atmosphere. On the other hand, the low intensity discharge lamp, such as that described in U.S. Pat. No. 3,500,118, above, operates at a temperature of approximately 40° C. and a vapor pressure of approximately 7 microns of Hg pressure. The high intensity discharge lamps typically consume a much greater amount of power and yield a correspondingly greater amount of optical output. The amount of power consumed depends in a positive way on the voltage drop along the discharge path. For a high intensity discharge lamp, there is a typical electric field strength of approximately 10 volts per centimeter; however, for a more standard, low intensity discharge, the electric field strength is approximately 1 volt per centimeter. This higher power rating requires a better coupling between the magnetic field within the ferrite and the electric field driven discharge. In addition, this higher power requirement also requires a certain amount of heat dissipation and cooling capability that is not required in low intensity discharge lamps. But at the same time, improvements made in the coupling and heat sinking must not appreciably interfere with the visible light output of the lamp.

SUMMARY OF THE INVENTION

In accordance with one embodiment of the invention, a plurality of toroidal ferrite cores are regularly disposed about a toroidal shaped discharge tube, the discharge tube threading through the holes in the ferrite toroids. A primary winding is similarly threaded through the holes in the ferrite toroids. An additional outer glass envelope is provided as a protection for the inner quartz or ceramic envelope through which the discharge passes. This configuration permits a very heavy concentration of ferrite to pass through the central portion of the discharge tube toroid; however, since the ferrite toroids are disposed along radial lines of the discharge tube toroid, the amount of ferrite toroidal material which obstructs the visible light emanating from the discharge tube is a minimum. Additionally, reflecting structural and heat sinking means are provided.

In accordance with another embodiment of the present invention, a bundle of ferrite rods contained in a right cylindrical dielectric sleeve is disposed through the hole of a discharge tube toroid. It is also disposed through the hole of the toroidal shaped outer glass envelope which serves to protect the discharge tube toroid which operates at a high temperature, typically 700° C. This packing arrangement for the ferrite rods forms the channels through which air or other cooling medium can pass. The power is supplied to the lamp by means of a helical winding driven by a radio frequency power source. Additionally, a combination magnetic flux expander and light reflector is provided.

Accordingly, it is an object of this invention to provide ferrite core structures configured with a toroidal discharge tube as part of a high intensity discharge solenoidal electric field lamp in which there is provided cooling and heat sinking capabilities with a minimal impact on the unobstructed light output, and in which there is also provided a good coupling between the magnetic and electric fields.

DETAILED DESCRIPTION OF THE INVENTION

Figure 2:
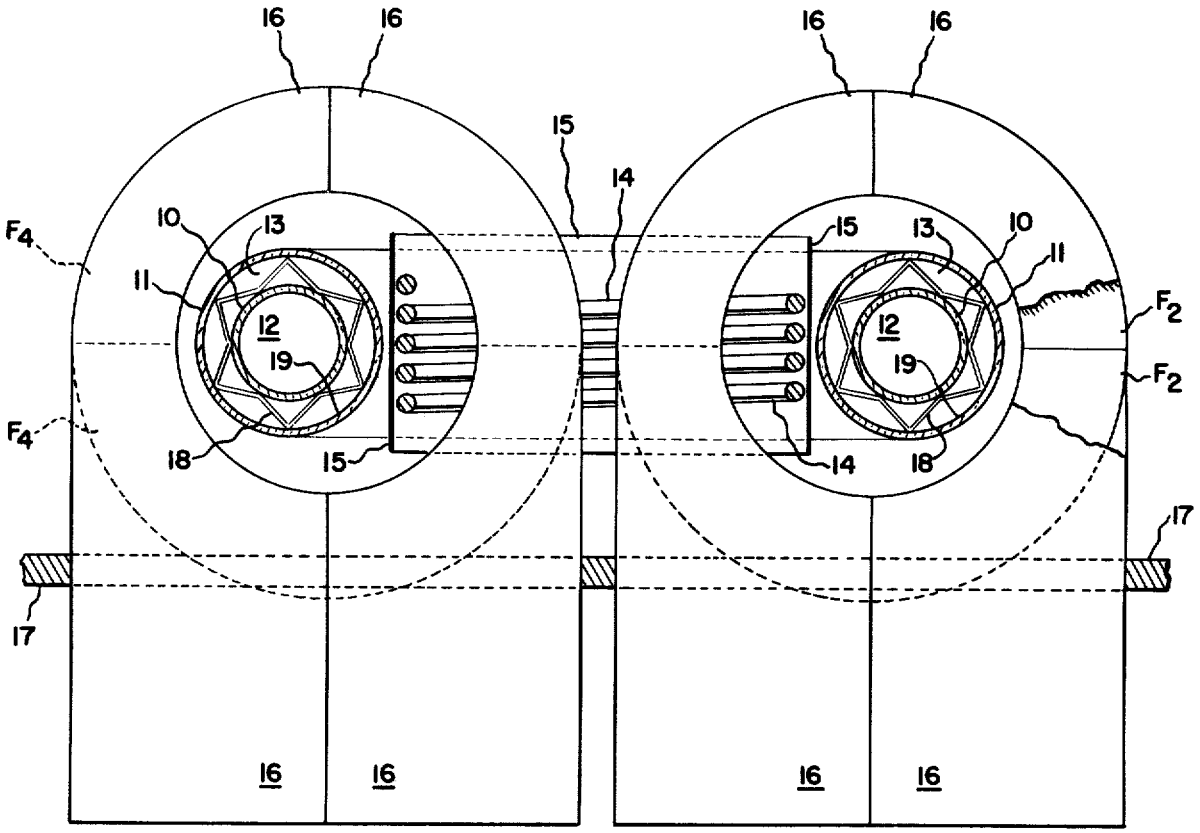
FIG. 2 is a partial sectional elevation view of the embodiment shown in FIG. 1.
Figure 3:
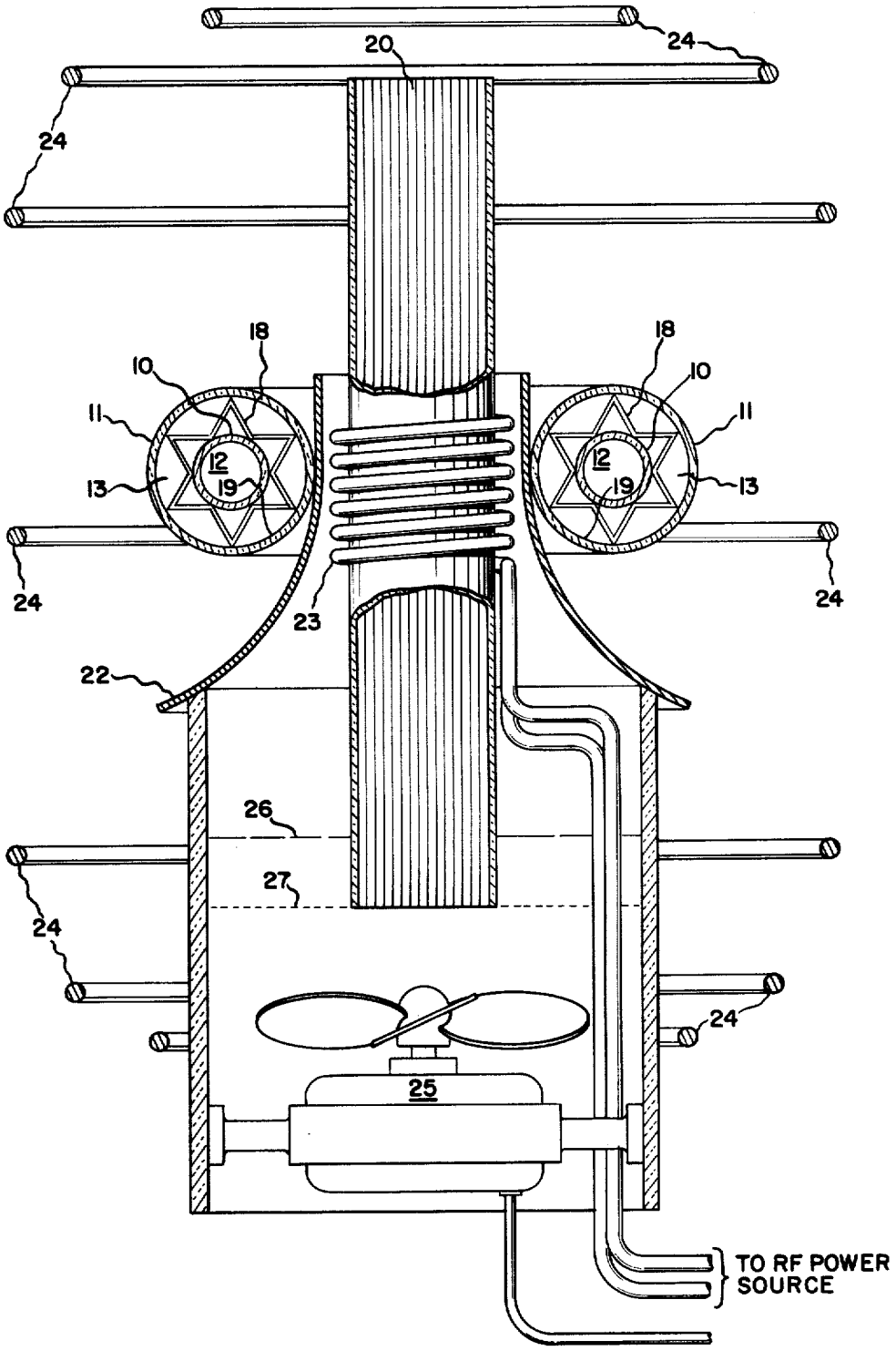
FIG. 3 is a sectional elevation view showing the geometry employing a bundle of ferrite rods in accordance with one embodiment of the present invention.

There are two basic embodiments of the invention herein. The first embodiment describes a structural geometry in which a plurality of ferrite toroids are disposed along the circumference of a discharge tube toroid which passes through the holes in the ferrite toroids. The second embodiment of the present invention is a structure in which a bundle of ferrite rods is disposed through the hole in the discharge tube toroid. The first embodiment is shown in FIGS. 1 and 2 and the second embodiment is shown in FIG. 3.

Since both embodiments of the present invention deal with toroidal shapes, it is desirable here to particularly define some of the terms used to better facilitate an understanding of the geometry. Thus, a "toroid" is typically a surface of revolution formed by rotating a circle about an "axis of rotation" not passing through the circle. The distance from the center of the circle to the axis as measured perpendicularly is referred to herein as the "major radius"; and the radius of the circle itself is referred to herein as the "minor radius". It is also possible to form a toroidal shape by rotating a rectangle about an axis with which it does not intersect and this is also referred to herein as a "toroid". Cross-sections formed by planes passing through a toroid are, for our purposes, of two basic kinds. First, the cross-section formed by a plane passing through the toroid and perpendicular to the axis of rotation produces two concentric circles and is referred to herein as a "horizontal cross-section". Second, the cross-section formed by a plane passing through the toroid and wholly containing the axis of rotation produces two disjoint intersections, each of which is circular in the case where the toroid is formed by the rotation of a circle about the axis, or rectangular in the case in which the toroid is formed by the rotation of a rectangle about the axis. This latter cross-section is referred to herein as a "vertical cross-section". In addition, it is possible to move the circle or rectangle about the axis of rotation along a noncircular, simple, closed, planar path such as the path delineated by a second rectangle. In the specification and the appended claims herein, this more general definition of a toroid is intended for the ferrite cores, but not the discharge tubes.

Figure 1:
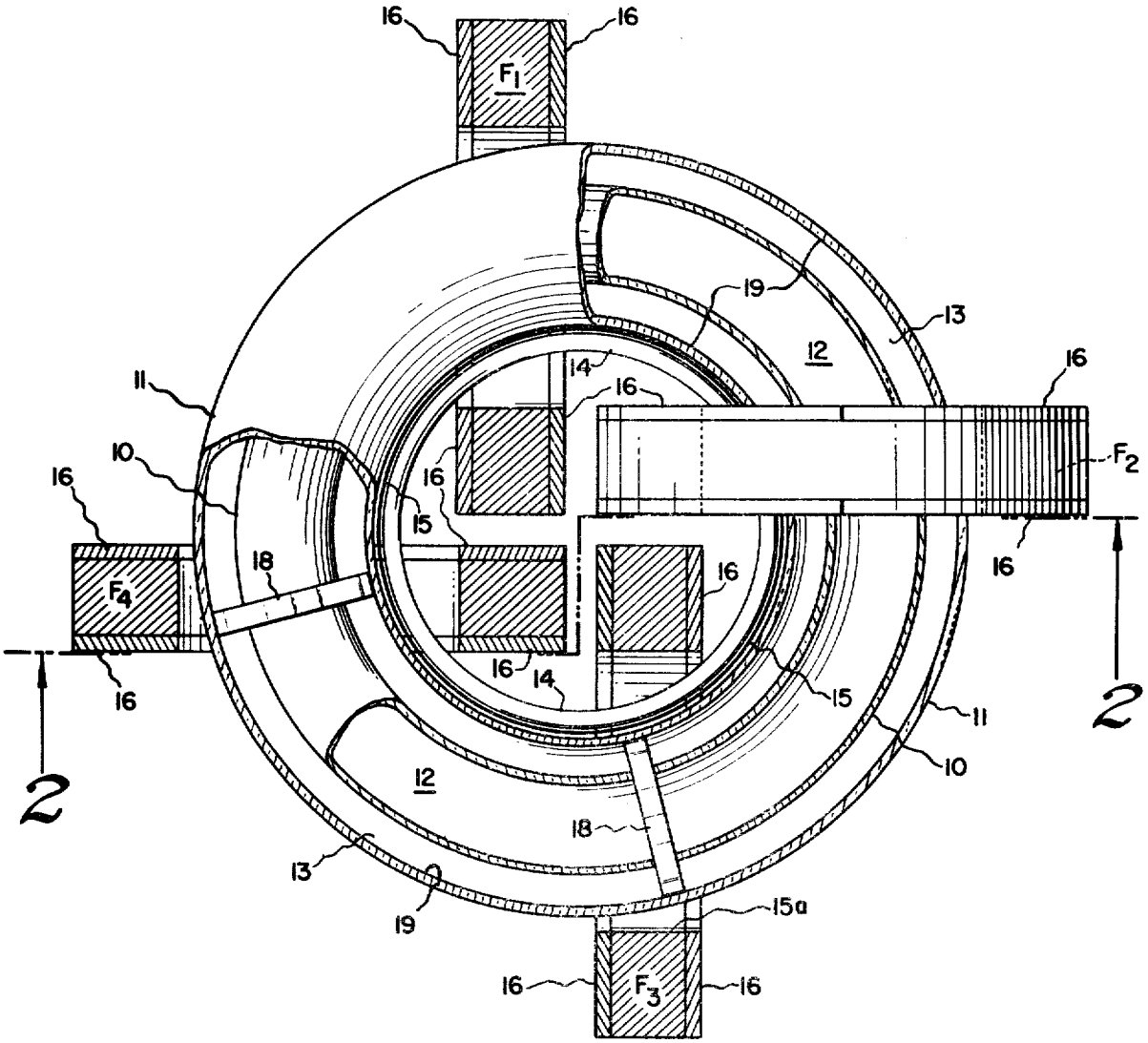
FIG. 1 is a sectional plan view of the geometry employing toroidal ferrite cores in accordance with one embodiment of the present invention.

FIG. 1 is a sectional plan view showing one embodiment of the present invention. In this first embodiment, four toroidal ferrite cores $F_1$, $F_2$, $F_3$, $F_4$, are disposed circumferentially about two inner glass toroids 10, 11. The inner toroid 10, is the discharge tube for the ionizable gas 12 contained therein. The discharge tube toroid 10 is wholly contained within the outer glass enveloping toroid 11 with a buffer gas 13, or vacuum, contained between the inner toroid 10 and the outer toroid 11. The inner toroid 10 is supported within outer toroid 11 by means of corrugated, resilient metal or glass straps or bands 18 of a refractory metal, such as tungsten or molybdenum or glass such as quartz. As a point of concern for assembly, it is noted that the usual mode of assembly is to work with the glass toroidal members intact. The ferrite toroids are each cut into two halfs and reassembled around the toroidal glass tubes. Heat conducting metal plates are placed on the flat faces of the ferrite toroids and this assembly placed on the base plate.

As shown in FIG. 1, there is a large concentration of ferrite material in the core of the toroid, but because of the inverse square effect, the concentration of ferrite material diminishes as one moves away from the center of the toroid. The advantage of such a structure is that a good coupling is achieved between the oscillating magnetic field contained within the ferrite toroids and the oscillating electric field occurring in a circumferential fashion within discharge tube 10. At the same time as good coupling is achieved, there is a minimal interference by way of obstruction caused by the ferrite toroids. Furthermore, cylindrical radiation shield member 15 is coated, if desired, with a suitable specular or diffuse reflecting material. Also reflecting surfaces 15*a* may be placed on the inner surfaces of the ferrite toroid. In addition, the supports 18 for the inner glass toroid 10 are preferably arranged at the same locations as the ferrite toroids.

FIG. 1 shows an embodiment in which there are four ferrite toroidal cores. However, it is possible to use a lesser or greater number of ferrite toroids. If a greater number of ferrite toroids is employed, then the coupling is improved at the expense of a somewhat greater amount of obstruction which effect would be somewhat mitigated by the fact that if a greater number of ferrite toroids is employed, then they may be of a somewhat diminished dimension. If a lesser number of ferrite toroids is employed, then the problem of their obstructing the visible output is mitigated, but this is done at the cost of the coupling of the magnetic and electric fields. However, if a lesser number of ferrite cores is employed, then their dimensions may be correspondingly increased so as to somewhat alleviate the reduced coupling efficiency.

The exact shape of the ferrite "toroids" employed is variable, but it has been found that ferrites in the form of a relatively thick annular disk or washer are well suited to survive the thermal stresses that may develop in a lamp of this configuration. In short, this particular shape of ferrite core has a much reduced chance of mechanical fracture and magnetic deterioration.

The inner glass toroid is the discharge tube through which the ionization current circulates. This transparent tube is usually of quartz or a ceramic so that it can withstand the high temperatures present, these being in the neighborhood of 700° C. or more. The inner quartz or ceramic toroid 10 typically contains an ionizable gaseous medium, such as mercury vapor, at a pressure of approximately 200 Torr. In addition, other additives, such as metal halides may be present or sodium at high pressure may be used along with mercury and xenon.

Outer envelope 11 may have a phosphor coating 19 on its inner surface such as employed occasionally to improve the color of HID mercury discharges. The phosphor is stimulated into emission of visible wavelength radiation upon excitation by the ultraviolet radiation which results from the electric discharge through the ionized mercury vapor. For example, a desirable phosphor is calcium halo-apatate. Others include europium doped yttrium vanadate.

By way of example, and not by way of limitation, a suitable embodiment of the present invention may be made in which the inner quartz discharge tube 10 possesses a minor radius of approximately 0.85 cm and a major radius of approximately 5 cm. In this configuration, the mean circumference along the discharge tube is approximately 32 cm. The circumferential distance is important becuase it controls the length of the discharge. The length of the discharge and the voltage drop per centimeter along the discharge are controlling parameters in determining the amount of power consumed by the lamp.

Between the inner toroidal envelope 10 and the outer toroidal envelope 11, and depending upon the temperature employed, there is present either a buffer gas 13, or a vacuum. For example, a buffer gas of nitrogen or argon may be used and is typically present at a pressure of approximately 500 to 600 Torr at room temperature. During the operation of the lamp the increase in temperature in this gas results in a pressure of approximately 1 atmosphere. This is a desirable pressure in that the dangers resulting from explosion or implosion are minimized in the event that the lamp is dropped or otherwise damaged. If the inner discharge tube 10 is made of Lucalox ® then it is possible to operate such a lamp at a temperature of up to approximately 1200° C. In the event of these high temperatures, however, it is desirable that as much insulation as possible exist between the inner and outer toroidal envelopes, 10 and 11, and here it is preferable that the space between toroids 10 and 11 be evacuated of all gases. Furthermore, the outer toroidal envelope 11, being subjected to much lower temperatures, may be composed of a more conventional glass, such as Pyrex ®. This outer glass envelope 11 typically possesses the same major radius as the inner discharge tube toroid 10, but its minor radius is larger than the minor radius of the discharge tube 10.

Through each ferrite toroid there is also wound a plurality of electrical conductors in a substantially helical fashion. These conductive windings 14 are shown in FIG. 1 and FIG. 2. Each conductive winding passes through each of the ferrite toroids. However, it is also possible to provide each individual ferrite toroid with its own winding. The chief advantage of this embodiment is that the primary winding voltage requirements for each individual toroid is thereby reduced and the individual ferrite toroids can be driven by a corresponding plurality of solid state radio frequency power supply sources each having lower voltage requirements for the active semiconductor devices. It is necessary, however, to synchronize the individual power supplies. To achieve the coupling desired, only three or four winding loops are sufficient. However, because of the amounts of power consumed by the lamp, it may be necessary to coat these RF windings with a temperature-resistive coating, such as Teflon ®.

To provide some protection for the primary winding, radiation shield 15, a hollow cylindrical metallic member 15 with at least one vertical slot is provided. In addition, this radiation shield for visible and infrared radiation may also be coated with a specular or diffuse reflecting substance, facilitating the direction of the visible light output in a desired direction, away from the lamp. In this embodiment of the present invention, an additional radiation shield may be provided as will be described later in connection with FIG. 3 for controlling electromagnetic interferences. However, it is much less a necessary feature in this embodiment since all but trace amounts of the magnetic field flux are contained within the ferrite cores themselves.

In FIG. 1, it is also shown that heat sinking straps or plates 16 may be provided, not only to provide a heat dissipating function, but also to serve as a mounting and retaining means for the ferrite toroids $F_1$, $F_2$, $F_3$, $F_4$. Structural supporting base plate 17, if desired, may be coated with a suitable reflecting substance. For example, a diffuse reflecting surface may be provided on supporting structural member 17, on the heat conducting plates 16, and on the reflecting shield 15 by means of a coating of barium sulfate which provides a diffusely reflecting surface and is also capable of withstanding the temperatures developed in the vicinity of the lamp. In addition, reflective coatings may be applied to the ferrite toroids themselves.

By way of example, the high intensity discharge solenoidal electric field lamps described above may be operated under the following conditions. A radio frequency voltage of between approximately 50 kilohertz and approximately 2 megahertz, but preferably at a frequency of approximately 500 kilohertz, is applied to the windings threaded through the ferrite cores of the lamp structure. With an approximately 8 ampere supply current, there is induced along the discharge path a voltage of approximately 160 volts, corresponding to a voltage drop of approximately 5 volts per centimeter. Under these conditions, the 8 ampere current in the discharge indicates a power consumption of approximately 1,280 watts. Under these operating conditions, there is less than approximately 100 watts of power being lost in the ferrite cores. Under these conditions, the lamp described produces a visible output of approximately 77,000 lumens, or approximately 60 lumens per watt, as compared with the approximately 25 lumens per watt produced by the standard incandescent lamp. It is understood, however, that for this amount of power consumption the lamp structure described herein is more appropriate for commercial and industrial settings, for example, parking lot illumination.

There are several concerns present in such high intensity discharge lamps which are not present in the lower intensity discharges such as those found in standard fluorescent lamps. For example, the length of the discharge is critical in that it is strongly and positively related to the amount of power consumed by the lamp. This greater power consumption requires a greater amount of power dissipation from the lamp. In addition, any geometry must efficiently couple the magnetic and electric fields present. In a low intensity discharge lamp, this is a relatively minor problem since coupling may be achieved at a number of places along a relatively long length of discharge tube. However, the luxury of a long discharge tube is not available in a high intensity discharge lamp because of the resultant power consumption.

As can be appreciated from the discussion above, the structure described provides for a maximum amount of ferrite material along a minimum discharge arc length. A minimally obstructed output light path is also provided along with ancillary means in a form of reflecting surfaces to direct the visible output of the lamp in those directions desired. In addition, the length of the conducting wire from the radio frequency (RF) power source is a minimum and there is furthermore the ready ability to provide thermal dissipation means.

Another embodiment of the present invention is illustrated in FIG. 3. FIG. 3 also describes a structure for a high intensity discharge solenoidal electric field lamp with improved cooling capabilities and with a virtually unobstructed optical output path. In this embodiment, discharge tubes 10 and surrounding glass envelope structure 11 are configured and filled with appropriate gases, as described above. However, in this configuration, the magnetic field is coupled to the electric discharge field by means of a bundle of cylindrical ferrite rods 20 contained within a cylindrical dielectric sleeve 21 composed of a material such as Pyrex ®. By way of example, and not limitation, a typical bundle contains 107 cylindrical ferrite rods, each having a diamter of approximately 0.64 cm and a length of approximately 17 cm and all together forming a bundle approximately 7 cm in diameter. Because of the circular nature of the ferrite rods and their being packed within a circular cylinder, it is impossible to achieve a 100 percent packing efficiency, and in fact a packing efficiency of approximately 90% results. Moreover, the channels that result in the ferrite bundle serve as an excellent path for cooling air, such as that provided by fan 25. The power to the lamp is supplied by a conductive winding around the ferrite bundle, typically in a helical pattern. This winding is connected to an RF power source. However, because of the temperatures developed in the lamp, it may be necessary to coat the conductive windings with a heat resistant material, such as Teflon®. The bundle of ferrite rods is disposed along the axis of the discharge tube toroid, extending approximately the same distance on either side of the discharge tube toroid. Also disposed between the windings and the glass toroids of the lamp is a reflecting shield 22. This shield 22 acts as a magnetic flux expander. It is typically made out of a high conductivity metal, such as aluminum. It is also necessary that vertical slots be present in this reflecting shield 22 in order that a circular current path, concentric with the current path within the discharge tube, is not set up within the metal reflector 22 by the changing magnetic field. If this is not done, the reflector 22 is inductively heated and thereby wastes energy. The reflector 22 may also be coated with an optically reflective substance similar to the shield 15 in the embodiment described above and shown in FIG. 1. The reflector is supported on cylindrical sleeve 22 which is either composed of a dielectric or a metal material. If no other means are provided for retaining the ferrite rods 20 within the dielectric sleeve 21, then, at least when in the vertical position, a Faraday screen 27 supports and maintains the bundle of ferrite rods 20 and the dielectric sleeve 21. Also present is a partially perforated member 26 serving to prevent the cooling air, at least in part, from passing up and past the reflector 22 directly. Perforated cylindrical member 26 serves to keep a substantial amount of flowing air passing over the bundle of ferrite rods 20. Perforated member 26 does, however, permit some cooling of the Teflon®-coated winding 23. In addition, because the lines of magnetic flux in this embodiment are permitted to return to the other end of the ferrite bundle through the atmosphere, it is more desirable here than in the previous embodiment to provide electromagnetic shielding conductors 24, which may be part of an active or passive shielding system.

By way of example, the high intensity discharge lamp structure illustrated in FIG. 3 may be operated in an RF frequency range of between approximately 1.6 megahertz and between approximately 15 megahertz. It is to be noted that in this range, there is contained the ISM band at 13.56 megahertz. The lamp can operate at up to approximately 10 or 11 volts per centimeter with a corresponding voltage drop along the discharge length of approximately 350 volts. Under these conditions, the inner quartz or ceramic tube 10 is operating at a temperature of approximately 700° C. At even higher frequencies, say between 50 megahertz and 100 megahertz, it is possible to excite the discharge tube by means of an air core instead of a ferrite core. However, the ferrite core is preferred and usable ferrites for this application may be either Q-1 (as supplied by Indiana General, Inc.) or K-5 (as supplied by TDK Electronics, Inc.). The flux level used to drive the ferrite rods is approximately 113.8 Gauss at a frequency of 2 megahertz, which is preferable. Since the power loss in these ferrite materials at this frequency is approximately 310 mw/cc at this flux level, the total power loss in the ferrite material is only approximately 53 watts. This is a very satisfactory level, considering the large amount of power consumed by the lamp which, in typical applications, is approximately 80,000 lumens for a net efficiency of approximately 80 lumens per watt.

As can be appreciated from the above description of the second embodiment of the present invention, there is provided therein a structural geometry for a high intensity discharge solenoidal electric field lamp in which there is sufficient coupling, which is easily cooled, and which provides a virtually unobstructed optical output light path.

While this invention has been described with reference to particular embodiments and examples, other modifications and variations will occur to those skilled in the art in view of the above teachings. Accordingly, it should be understood that, within the scope of the appended claims, the invention may be practiced otherwise than is specifically described.

The invention claimed is:

1. A high intensity discharge, solenoidal electric field lamp comprising:

an inner toroidal shaped discharge tube containing a suitable ionizable gaseous medium which emits visible wavelength radiation when a current traverses said ionizable medium, said medium being at a pressure of between approximately 200 torr and approximately one atmosphere;

an outer toroidal shaped transparent protective tube wholly surrounding said discharge tube;

means for centrally spacing said inner discharge tube within said outer protective tube, so that the surfaces of neither come in contact;

a plurality of toroidal shaped ferrite cores disposed in a substantially regular manner circumferentially about the inner discharge tube and the outer protective tube in the form of interlocking rings; and means to couple the ferrite cores to a radio frequency power source.

2. The lamp of claim 1 in which the ionizable medium is mercury vapor.

3. The lamp of claim 1 in which there is a coating on the outer toroidal protective tube said coating being selected from the group consisting of calcium halo-apatate and europium doped yttrium vanadate.

4. The lamp of claim 1 in which the inner discharge tube is of a material selected from the group consisting of quartz and transparent ceramics.

5. The lamp of claim 1 in which the outer protective tube is Pyrex®.

6. The lamp of claim 1 in which the means for centrally spacing the inner discharge tube within the outer protective tube comprises a a plurality of circular, corrugated, refractory bands.

7. The lamp of claim 6 in which the refractory bands are selected from the group consisting of molybdenum, tungsten and quartz.

8. The lamp of claim 1 in which the toroidal shaped cores have rectangular vertical cross sections.

9. The lamp of claim 1 in which the means to drive ferrite cores comprises a plurality of windings of a single conductor, each such winding being threaded through each ferrite core, said windings having a radius no greater than necessary to circumscribe said ferrite cores, whereby a minimum winding length is provided.

10. The lamp of claim 1 in which the means to drive the ferrite cores operates at a frequency of between 50 kilohertz and 2 megahertz.

11. The lamp of claim 1 in which the means to drive the ferrite cores operates at a frequency of approximately 500 kilohertz.

12. The lamp of claim 1 in which there are separate means to drive each ferrite core, said means operating in a synchronized fashion.

13. The lamp of claim 1 in which the ferrite toroids are mounted to heat-sinking means.

14. The lamp of claim 1 additionally comprising:
a cylindrical, vertically slotted, metallic, reflective shield disposed just within the toroidal hole of the outer protective tube.

15. The lamp of claim 1 in which the ferrite cores are coated with a reflective material.

16. The lamp of claim 1 additionally comprising:
a buffer gas between said inner and outer toroidally-shaped tubes.

17. The lamp of claim 16 in which the buffer gas is selected from the group consisting of nitrogen and argon.

18. The lamp of claim 16 in which the buffer gas is at a pressure of between approximately 500 and 600 Torr at room temperature.

19. The lamp of claim 1 in which the ionizable medium further comprises metal halide additives.

20. The lamp of claim 1 in which the ionizable medium comprises mercury vapor with xenon and sodium as additives.

21. A high intensity discharge, solenoidal electric field lamp comprising:
an inner toroidal shaped discharge tube containing a suitable ionizable gaseous medium which emits visible wavelength radiation when a current traverses said ionizable medium, said medium being at a pressure of between approximately 200 torr and approximately one atmosphere;
an outer toroidal shaped transparent protective tube wholly surrounding said discharge tube;
means for centrally spacing said inner discharge tube within said outer protective tube, so that the surface of neither come in contact;
a bundle of ferrite rods disposed along the axis of said toroidal tubes, said tubes being substantially equidistant from the ends of said bundle, said bundle of ferrite rods defining a plurality of channels traversing the length of said bundle along said rods;
means to couple the ferrite rods to a radio frequency power source.

22. The lamp of claim 21 in which the ionizable medium is mercury vapor.

23. The lamp of claim 21 in which there is a coating on the outer toroidal protective tube said coating being selected from the group consisting of calcium halo-apatate and europium doped yttrium vanadate.

24. The lamp of claim 21 in which the inner discharge tube is of a material selected from the group consisting of quartz and transparent ceramics.

25. The lamp of claim 21 in which the outer protective tube is Pyrex®.

26. The lamp of claim 21 in which the means for centrally spacing the inner discharge tube within the outer discharge tube comprises a plurality of circular, corrugated refractory bands.

27. The lamp of claim 26 in which said refractory bands are selected from the group consisting of molybdenum, tungsten, and quartz.

28. The lamp of claim 21 in which the means to drive the ferrite rods comprises a plurality of insulated windings of a single conductor around the ferrite bundle, the ends of said conductor being attached to a radio frequency power source.

29. The lamp of claim 21 in which the means to drive the ferrite rods operates at a frequency of between approximately 1.6 megahertz and approximately 15 megahertz.

30. The lamp of claim 29 in which the means to drive the ferrite rods operates at a frequency of approximately 2 megahertz.

31. The lamp of claim 21 additionally comprising:
a cylindrical, vertically slotted, metallic, reflective shield disposed just within the toroidal hole of the protective tube, said shield being flanged so as to act as a magnetic flux expander.

32. The lamp of claim 21 additionally comprising:
a buffer gas between said inner and outer toroidally-shaped tubes.

33. The lamp of claim 32 in which the buffer gas is selected from the group consisting of nitrogen and argon.

34. The lamp of claim 32 in which the buffer gas is at a pressure of between approximately 500 and 600 Torr at room temperature.

35. The lamp of claim 21 in which the ferrite rods are contained within a cylindrical dielectric sleeve.

36. The lamp of claim 35 in which said sleeve is Pyrex®.

37. The lamp of claim 21 in which the ionizable medium further comprises metal halide additives.

38. The lamp of claim 21 in which the ionizable medium comprises mercury vapor with xenon and sodium additives.

39. The lamp of claim 21 further comprising:
means for passing a cooling fluid through said channels in the ferrite bundle.

* * * * *